US009109438B2

(12) United States Patent
Stehle

(10) Patent No.: US 9,109,438 B2
(45) Date of Patent: Aug. 18, 2015

(54) DEVICE AND METHOD FOR WELL STIMULATION

(75) Inventor: Vladimir Stehle, Kassel (DE)

(73) Assignee: WINTERSHALL HOLDING GmbH, Kassel (DE)

( * ) Notice: Subject to any disclaimer, the term of this patent is extended or adjusted under 35 U.S.C. 154(b) by 682 days.

(21) Appl. No.: 13/307,709

(22) Filed: Nov. 30, 2011

(65) Prior Publication Data

US 2012/0138302 A1 Jun. 7, 2012

Related U.S. Application Data

(60) Provisional application No. 61/418,891, filed on Dec. 2, 2010.

(51) Int. Cl.

| | |
|---|---|
| ***E21B 43/11*** | (2006.01) |
| ***E21B 43/263*** | (2006.01) |
| ***E21B 43/116*** | (2006.01) |

(52) U.S. Cl.

CPC ..... *E21B 43/11* (2013.01); *E21B 43/116* (2013.01); *E21B 43/263* (2013.01)

(58) Field of Classification Search

CPC ..... E21B 43/26; E21B 43/263; E21B 43/248; E21B 43/11; E21B 43/116; F42B 3/04

USPC ..... 166/299, 308.1, 311, 63

See application file for complete search history.

(56) References Cited

U.S. PATENT DOCUMENTS

| | | | | | |
|---|---|---|---|---|---|
| 2,697,399 | A | * | 12/1954 | McAdams | 102/317 |
| 3,151,679 | A | * | 10/1964 | Karpovich et al. | 166/299 |
| 3,332,349 | A | * | 7/1967 | Schwoyer et al. | 102/317 |
| 4,018,293 | A | * | 4/1977 | Keller | 175/4.5 |
| 4,798,244 | A | * | 1/1989 | Trost | 166/250.01 |
| 4,823,876 | A | * | 4/1989 | Mohaupt | 166/299 |
| 5,355,802 | A | * | 10/1994 | Petitjean | 102/313 |
| 6,138,753 | A | * | 10/2000 | Mohaupt | 166/250.02 |
| 6,817,298 | B1 | * | 11/2004 | Zharkov et al. | 102/312 |
| 2005/0045336 | A1 | * | 3/2005 | Hayes | 166/312 |
| 2008/0271894 | A1 | | 11/2008 | Hill et al. | |
| 2010/0175879 | A1 | * | 7/2010 | Robertson | 166/298 |

FOREIGN PATENT DOCUMENTS

| | | |
|---|---|---|
| RU | 2 151 282 C1 | 6/2000 |
| RU | 2 176 728 C1 | 12/2001 |
| RU | 2 307 921 C2 | 10/2007 |
| RU | 2 311 529 C2 | 11/2007 |

* cited by examiner

*Primary Examiner* — Shane Bomar
*Assistant Examiner* — David Carroll
(74) *Attorney, Agent, or Firm* — Oblon, McClelland, Maier & Neustadt, L.L.P.

(57) ABSTRACT

A device for well stimulation comprising a carrying element (22) with a first delimiting element (23) and a second delimiting element (25), also at least one charge pack (30), which comprises one or more charge units (31) of a solid fuel, and also at least one detonator (40) for detonating the at least one charge pack (31), the charge pack or the charge packs being arranged on the carrying element (22) between the delimiting elements (23, 25), wherein the charge units (31) are configured as cylinders with a continuous axial clearance, and the carrying element (22) is formed as a rod or cable and is led through the axial clearances.

14 Claims, 15 Drawing Sheets

DEVICE AND METHOD FOR WELL STIMULATION

Figure 1:
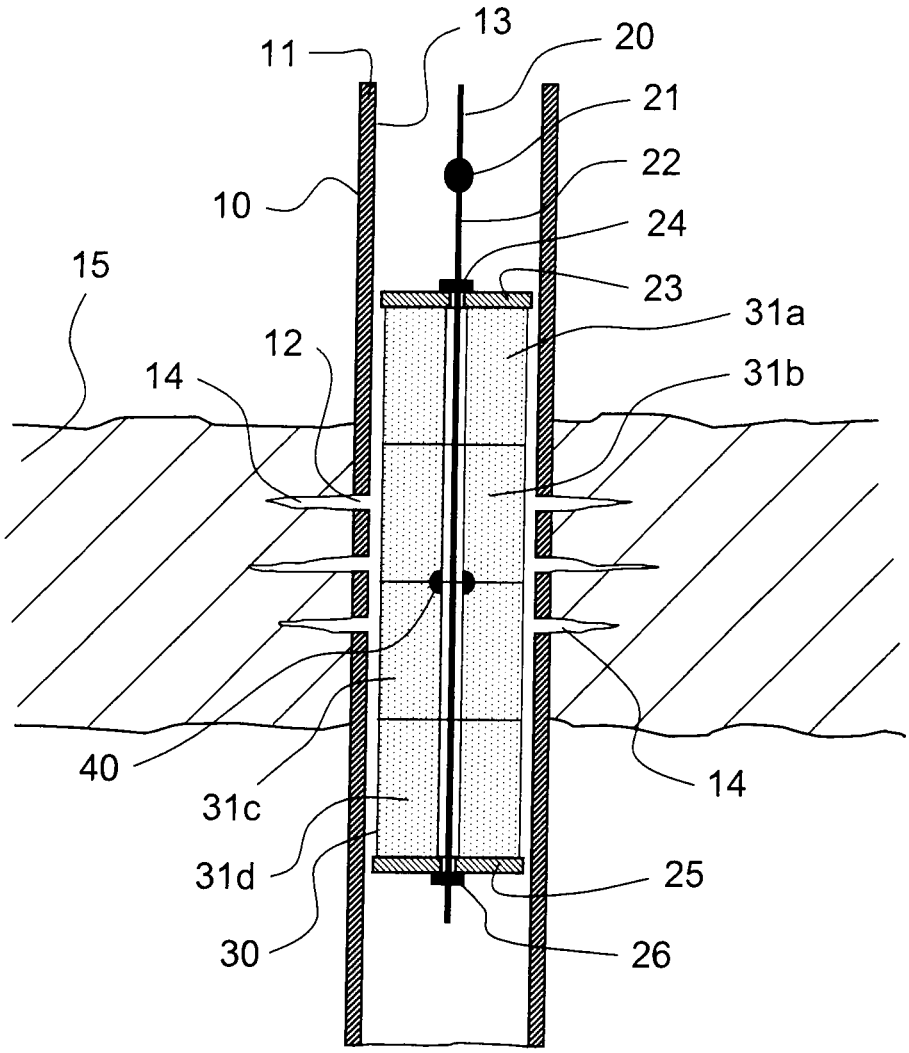

This patent application claims the benefit of U.S. provisional patent application Ser. No. 61/418,891 filed Dec. 2, 2010 incorporated in its entirety herein by reference.

The present invention relates to a device for well stimulation comprising a carrying element with a first delimiting element and a second delimiting element, also at least one charge pack, which comprises one or more charge units of a solid fuel, and also at least one detonator for detonating the at least one charge pack, the charge pack or the charge packs being arranged on the carrying element between the delimiting elements. The invention also relates to a method for well stimulation using the device according to the invention.

In the extraction of fluids such as mineral oil or natural gas from underground rock formations, the productivity of an extraction plant depends to a great extent on the permeability of the rock formations around the well. The more permeable these rock formations are, the more cost-effectively a reservoir can be exploited. Both when a reservoir is being developed and during extraction from it, it may happen that the permeability is reduced and that consequently there are disadvantageous effects.

When producing wellbores, both for production wells and for injection wells, it can happen during the drilling and cementing process that the porous rock formations become silted up, so that there is a decrease in permeability. Furthermore, the rock in the area around the well changes in its state of stress, compression and deformation, which has the effect that zones with increased density and low permeability form circularly around the well. During the operating phase of the well, paraffins, asphaltenes and highly viscous tars often form deposits in the rock, reducing the productivity of the well.

Among the most well-known methods of counteracting a reduction in the permeability of the area of the well are various perforation technologies, vibrational and thermal treatment, the use of chemically active substances and swabbing. One type of perforation technology uses gas generators, which are operated with solid fuels. They take the form of encased or unencased explosive charges and, after being detonated, produce hot gases, which result in a pressure increase in the well and the surrounding rock formations. Gas generators are usually used in the well at the level of the production zone, to bring about new perforations in the rock or to widen existing perforations as a result of the increase in pressure.

Russian patent RU 2311529 C2 discloses a method for well stimulation by means of a gas generator in oil and gas extraction. The device comprises tubular, cylindrical explosive charges, detonation charges and a geophysical cable, known as a logging cable, with fastening elements for the explosive charges. The cable may be located inside a winding cable, so that the gas generator can also be used for angled, directed and horizontal wells. During the burning of the cylindrical explosive charges in the well, the rock undergoes thermo-gas-chemical and air-pressure treatment. If a perforation has first been carried out, the perforation channels are widened and cleaned, and fine cracks form in the rock. Under the effect of high pressure of the gas generators, these processes are intensified. Under some circumstances, extensive cracks can form. One disadvantage of this method is that the gases emitted spread quickly in the well shaft and, as a result, the amount of energy available in the region to be treated of the well is relatively low.

The patents RU 2176728 C1 and RU 2151282 C1 disclose gas generators that are operated with solid fuels. These gas generators consist of tubular explosive charges or explosive charges with longitudinal channels. Here, the length of the explosive charge and the diameter of the longitudinal channel depend on a specific ratio, which determines the pulsation of the pressure of the gases during the burning of the explosive charges.

Furthermore, the patent RU 2307921 C1 discloses a device for the perforation of wells and the gas-dynamic treatment of perforation zones directly after the formation of the perforation holes. This device comprises a perforator with explosive charges and two tubular explosive charges, which are located in the body and are produced from heat-resistant gas-generating components. One disadvantage of this device is its complicated construction and the insufficient energy concentration of the emitted gases in the perforation zone of the reservoir.

The document U.S. 2008/0271894 A1 discloses a device and a method for producing perforations in underground rock formations. Attached around a carrier are explosive charges, which after detonation produce perforations in the surrounding rock, and these are made to spread by an increase in pressure. The device is provided with sealing elements, which as the pressure increases deform in such a way that they lie against the wall of the well and thereby delimit the space for the pressure to develop.

It is an object of the invention to provide a device and a method for well stimulation by means of which the permeability of the rock around the region of the well can be improved specifically and efficiently. At the same time, the device should be of a simple construction and inexpensive to produce.

This object is achieved by the subject matter of the invention as reproduced in claims 1 and 7. Other advantageous embodiments of the invention can be found in the respective dependent claims. A further subject matter of the invention is specified in method claim 11 and the claims dependent on it.

The device according to the invention for well stimulation is hereafter referred to for short as a "gas generator". In a first configuration according to the invention, the gas generator comprises a carrying element, which is formed as a rod or cable. The carrying element is produced from a highly resistant material which is not destroyed during the burning of the charge packs in the well. In one embodiment, the carrying element is produced from steel, preferably from high-strength toughened steel. The carrying element may be surrounded by a protective sheath, in particular if the carrying element is in the form of a cable. The protective sheath is preferably produced from a highly resistant material, particularly preferably from a high-strength steel. The protective sheath prevents the carrying element from being damaged during the burning of the charge packs. It can easily be exchanged as and when required. In a preferred embodiment, the carrying element is in the form of a hollow rod or tube with a continuous axial channel.

According to the invention, a first delimiting element and a second delimiting element are attached to the carrying element. They are likewise produced from a material which is not destroyed during the burning of the charge packs. The delimiting elements are preferably produced from steel, in particular high-strength toughened steel. The delimiting elements are preferably formed as disks with a central axial bore, through which the carrying element can be led. Solid steel disks represent a version of the delimiting elements that is easy to produce. In preferred embodiments of the invention, the delimiting elements are fixedly connected to the carrying element, for example by means of fastening elements such as mechanical holders, clamps or screw connections.

The delimiting elements have in the axial direction, that is to say along the carrying element, an extent which is chosen to be at least great enough that the delimiting elements are not destroyed during the burning process. This minimum extent depends on the material properties of the delimiting elements and similarly on the properties and amount of the fuel used. The extent of the delimiting elements in the axial direction is preferably from 50% to 100%, particularly preferably from 70% to 100%, in particular from 90% to 100%, of the inner diameter of the well in the region in which the gas generator is used. Such an axial extent of the delimiting elements reliably prevents canting of the delimiting elements when the gas generator is introduced into the well.

The gas generator further comprises at least one charge pack, which comprises one or more charge units of a solid fuel. Solid fuels that come into consideration are those produced from heat-resistant, gas-generating components or from high-energy thermal mixtures, for example known fuels such as ballistite powder. Further examples of solid fuels are mixtures which comprise aluminum powder, carbon powder or polymethyl methacrylate powder as well as ammonium nitrate or ammonium perchlorate. Also suitable are mixtures of which the main component is ammonium chloride and which additionally comprise the following substances (given in percent by weight):

polyvinyl isoprene rubber with epoxy end groups (7 to 8)
transformer oil (5.6 to 6.5)
distilite titanium (0.6 to 1.5)
strontium carbonate (0.1 to 0.5)
combustion modifier (0.2 to 0.3)
aromatic amino acid (0.03 to 0.11)
aromatic amine (0.01 to 0.06)
curing catalyst (0.01 to 0.1)

The charge units are configured as cylinders with a continuous axial clearance. In a preferred embodiment, the charge units have a substantially circular cross section. Particularly preferably, the diameter of the charge units is from 8 to 15 cm, in particular from 10 to 12 cm. The diameter is advantageously chosen such that it is 10% to 20% less than the inner diameter of the well in the region in which the gas generator is used. The diameter of the axial clearance is preferably from 8 to 15 mm, particularly preferably from 10 to 12 mm. In the axial direction, the height of the individual charge units is preferably from 5 to 140 cm. The overall length of the charge pack or the charge packs is chosen in dependence on the axial extent of the perforation region of the production zone and is preferably from 0.5 to 30 m. The charge pack or the charge packs are arranged on the carrying element between the delimiting elements, in that the carrying element is led through the axial clearances in the charge units.

The perforation region is understood here and hereafter as meaning the region of a production zone in which perforation holes and perforation channels are already present or are to be created by use of the gas generator. The axial extent of the perforation region often corresponds to the thickness of the rock formation from which the fluid, for example mineral oil or natural gas, is to be extracted.

The gas generator according to the invention also comprises at least one detonator for detonating the at least one charge pack. The choice of detonator depends on the solid fuel used. Suitable detonators are known to a person skilled in the art, for example electric arc detonators or spiral detonators. In a preferred embodiment, the carrying element has inside it an axial channel through which, for example, electrical lines or other lines required for the detonation of the detonators can be led.

In a preferred configuration of the invention, a charge pack comprises a number of charge units, neighboring charge units having different outer diameters. The smaller outer diameters preferably have values in the range from 75% to 95% of the greatest outer diameter. The axial extent of the charge units with reduced outer diameter is preferably from 10% to 50% of the average axial extent of the charge units with non-reduced outer diameter. Particularly preferably, the charge units with non-reduced outer diameter have in each case the same axial extent.

More preferably, charge units which have smaller outer diameter are enclosed by an annular encasing, which is produced from a material which is not destroyed during the burning of the charge packs. The annular encasings are preferably produced from steel, in particular from high-strength toughened steel. Particularly preferably, the annular encasings are formed with the same axial extent as the charge unit concerned and with a wall thickness which compensates for the difference between the outer radii of neighboring charge units, so that the complete charge pack has substantially the same outer radius over its length.

In a preferred embodiment of the gas generator according to the invention, the entire space between the delimiting elements in the axial direction is filled with a charge pack. The detonator or number of detonators is or are arranged in such a way that, during the detonation, the burning of the charge pack begins in a middle region in the axial direction and continues in the direction of the first and second delimiting elements.

In an alternative configuration of the invention, the gas generator comprises two charge packs which are arranged spaced apart from each other on the carrying element. On or in each charge pack there is at least one detonator, so that the charge packs can be detonated simultaneously or one after the other in time. Particularly preferably, the two charge packs are of substantially the same length and form such that, during burning, virtually the same amounts of energy are released from both sides. The spacing between the two mutually facing ends of the charge packs is preferably at most as great as the axial extent of the perforation region in the well.

In a further preferred form of the invention, the gas generator also comprises at least one sealing pack of free-flowing solid material and at least one additional delimiting element, which is attached to the carrying element outside the intermediate space between the first delimiting element and the second delimiting element in the axial direction. In one configuration, an additional delimiting element is fixedly connected to the carrying element above the first delimiting element in the axial direction, and a sealing pack is arranged between the additional delimiting element and the first delimiting element. In a further configuration, an additional delimiting element is fixedly connected to the carrying element below the second delimiting element in the axial direction, and a sealing pack is arranged between the additional delimiting element and the second delimiting element. Sealing packs are preferably provided both at the upper end and at the lower end. In these advantageous configurations, the first delimiting element and/or the second delimiting element is/are mounted movably along the carrying element in the axial direction.

The additional delimiting element may be produced from various materials; it is preferably produced from a metal, in particular a high-strength toughened steel. Its form may correspond to that of the first or second delimiting element, for example a disk with a central bore, through which the carrying element is led. In a preferred configuration, the first delimiting element and/or the second delimiting element is formed in such a way that its diameter on the side facing the sealing element is less than the diameter on the side facing the charge pack. More preferably, the additional delimiting element is formed in such a way that its diameter on the side facing the sealing element is less than the diameter on the side directed outwardly. Particularly preferably, both the first and/or second delimiting element and the respective additional delimiting element are formed in such a way. Such a configuration in the form of a truncated cone is particularly advantageous.

The sealing packs are chosen such that on the one hand they remain stable during fitting into the gas generator and during introduction into the well, on the other hand however they lose their solidity when the pressure builds up as a result of the burning of the solid fuel charges. As a result of the pressure development, the sealing pack is compressed in the axial direction, the flowable solid material yields radially to the side and forms a sealing layer, which fills the entire cross section of the well in this region. The solid material can also flow into the annular spaces around the delimiting element, the charge pack and/or the additional delimiting element. Choosing a solid material with a high coefficient of friction, preferably compressed sand, allows the amount of solid material that flows into the annular spaces to be reduced. The amount of solid material that flows into the annular spaces can be reduced further by the delimiting element and/or the additional delimiting element being configured in the way described above with reduced diameter, preferably conically.

The amount of flowable solid material is set such that a sealing effect is maintained throughout a certain duration of the burning process of the charge packs. The length of a sealing pack is preferably from 0.5 to 1.5 m. The outer diameter of the sealing packs is preferably not greater than the outer diameter of the delimiting elements. The sealing pack may be encased, for example with a film of tear-resistant plastic. The advantage of the embodiments with a sealing pack is that a higher pressure level can be achieved in comparison with non-sealed versions under otherwise identical conditions.

In a further embodiment according to the invention, the gas generator also comprises two sleeves, which are produced from a material which is not destroyed during the burning of the charge packs. The sleeves are preferably produced from steel, in particular high-strength toughened steel. The sleeves enclose the charge packs in the radial direction. The first sleeve is attached by one end in a gastight manner to the first delimiting element, the second sleeve is attached by one end in a gastight manner to the second delimiting element. The other ends respectively of the sleeves are facing each other. The gastight attachment of the sleeve ends to the respective delimiting element may be performed for example by a welded connection. The wall thickness of the sleeves is chosen such that the sleeves are not destroyed during the burning of the charge packs. It is dependent on the properties of the material from which the sleeves are produced, on the dimensions of the charge packs and on the properties and amount of the solid fuel used. The sleeves are also referred to hereafter as "cases". A gas generator without sleeves is correspondingly referred to as "caseless".

In order to prevent canting of the gas generator when it is introduced into the well, when using caseless gas generators the axial extent of the first and second delimiting elements is preferably chosen in the ranges specified above. When using gas generators with a case, on the other hand, the delimiting elements may be made smaller in their axial extent, since canting of the gas generator in the well is avoided to the greatest extent just by the axial extent of the sleeve. However, to prevent destruction during the burning process, the axial extent of the delimiting elements is not allowed to be below the minimum even when using gas generators with a case.

In a first refinement of a gas generator according to the invention with a case, a continuous charge pack is arranged between the delimiting elements. In this case, the sleeves preferably do not completely enclose the charge pack in the axial direction. This means that there is a spacing between the mutually facing ends of the sleeves. This spacing is chosen particularly preferably such that it is at most as great as the axial extent of the perforation region in the well.

In a preferred version of this embodiment, the charge units that are enclosed by the sleeves are selected such that their burning rate is higher than that of the charge units that are not enclosed by the sleeves in the radial direction. After the detonation of the charge packs that are not enclosed by the sleeves, the burning results in the development of a first pressure wave, which propagates into the perforation openings. As soon as the charge packs in the sleeves are detonated by the burning, a second pressure wave is created, and this wave is greater than the first pressure wave as a result of the higher burning rate. In this way, pressure pulses that efficiently allow existing perforation channels to be widened and newly created can be specifically produced.

In a second refinement of a gas generator according to the invention with a case, the gas generator comprises two charge packs, which butt against the respective delimiting element and have an intermediate space between their mutually facing ends. In this case, the sleeves preferably completely enclose the respective charge pack also in the axial direction. The spacing between the mutually facing ends of the two sleeves is preferably at most as great as the axial extent of the perforation region in the well.

In a further preferred configuration of a gas generator according to the invention with a case, the two mutually facing ends of the sleeves are spaced apart from each other. Arranged in each sleeve is a charge pack, which butts against the respective delimiting element and only partially fills the sleeve in the axial direction. The gas generator further comprises two pressure pistons, which are attached to the carrying element movably in the axial direction. The pressure pistons preferably have a central axial bore, through which the carrying element is led. One end of the respective pressure piston protrudes into the open end of the corresponding sleeve; the end of the pressure piston preferably butts against the charge pack located in the sleeve. The other end of the respective pressure piston preferably protrudes beyond the open end of the sleeve and has an outer diameter which is greater than the inner diameter of the sleeve at its open end. Particularly preferably, the outer diameter of the pressure piston is also greater than the outer diameter of the sleeve at its open end, so that the pressure piston protrudes beyond the end of the sleeve in the radial direction. The outer diameter of the pressure piston is preferably 80% to 95% of the inner diameter of the well at the point at which the gas generator is used.

The mutually facing end faces of the pressure pistons have an axial spacing, which is advantageously chosen to be of such a size that it corresponds to the axial extent of the perforation region in the well. However, the spacing may also be chosen to be smaller, for example when there are extensive perforation regions. In a preferred configuration, the mutually facing end faces of the pressure pistons are of a planar form. In a particularly preferred configuration, the end faces are of a concave form, so that the axial spacing between the radially outer peripheries of the opposing end faces is less than the axial spacing between their center points. The pressure pistons may be produced from different materials, as long as they are not destroyed during the burning of the charge packs. The pressure pistons are preferably produced from a metal, in particular a high-strength toughened steel.

In this embodiment, there is a detonator in each charge pack; the detonator is preferably attached to the end of the charge pack that is facing the pressure piston. After detonation of the charge packs, the development of gas generates a pressure, which moves the two pressure pistons toward each other. This type of gas generator is preferably used if there is a liquid, for example water, in the perforation region between the end faces of the pressure pistons after the gas generator is introduced into the well. After the detonation of the charge packs, the pressure pistons moving toward each other bring about pressure waves, which collide in the center of the intermediate space and spread into the perforation openings. This type of pressure generation is very effective with regard to the widening of existing perforation channels and the formation of new perforations in the region near the well. The gas generators with concavely formed pressure piston end faces are particularly advantageous in this respect.

An alternative configuration of the invention concerns a gas generator which comprises a carrying element formed as a rod or cable, with a first delimiting element and a second delimiting element. A first sleeve is attached by one end in a gastight manner to the first delimiting element, a second sleeve is attached by one end in a gastight manner to the second delimiting element. The other, open, ends respectively of the sleeves are facing each other. The sleeves are respectively provided with a dividing wall, which extends in the axial direction from the open end of the sleeve in the direction of the delimiting element and divides the sleeves in each case into two chambers. Between the delimiting element and the dividing wall there is a spacing. By way of this intermediate space, the two chambers in each sleeve are connected to each other.

The spacing between the delimiting element and the dividing wall is preferably dimensioned such that the area over which the two chambers are connected to each other substantially corresponds to the cross-sectional area of the chambers. Particularly preferably, the cross-sectional areas of the two chambers are of substantially the same size in the respective sleeve. As a result, a uniform burning process is made possible.

One chamber per sleeve is respectively closed by a covering at the end opposite from the delimiting element. The sleeves are produced from a material which is not destroyed during the burning of the solid fuel. The chambers are respectively filled partly or completely with a solid fuel. At least one detonator per sleeve is arranged in such a way that the solid fuel in the sleeves can be detonated simultaneously or one after the other in time. Simultaneous detonation is preferred. The detonators, for example conventional electrical detonators, are preferably attached to the entrance of the respectively open chamber.

The dividing of the volume enclosed by the sleeve into two chambers allows the duration of the burning process to be prolonged. In comparison with a gas generator with a sleeve without a dividing wall, the intensity of the pressure development is reduced when using the same solid fuel. A gas generator of this type can therefore be advantageously used if the perforation region of the production zone is to be treated gently. This gas generator is preferably used if the fuel used has a high burning rate or large volumes of gas are released during burning.

In a further embodiment, the gas generator according to the invention also comprises a first end stop element and a second end stop element, which are both fixedly connected to the carrying element. In this embodiment, the delimiting elements are attached to the carrying element axially displaceably in the axial direction between the end stop elements. Sleeves and charge packs optionally attached to the delimiting elements are in this case likewise of an axially displaceable configuration.

In a preferred configuration of this embodiment, the gas generator comprises two charge packs and two sleeves, which completely enclose the charge packs in the radial direction. The sleeves are respectively connected in a gastight manner to a delimiting element. The axial extent of the sleeves is at least as great as that of the charge packs. The delimiting elements and sleeves are attached on the carrying element in such a way that there is no spacing, or only a slight spacing, between the mutually facing ends of the sleeves. An arrangement in which there is no spacing is particularly preferred. The sleeves are connected to each other at the mutually facing ends in such a way that, during a detonation of the charge packs, the pressure produced is sufficient for the two sleeves to be separated from each other. Such a connection may be performed for example by spot welding. A further possibility is a connecting element which, as a result of its material properties or material thickness, fails under a defined pressure, so that the connection is released, for example in the form of a thin fastening ring. Such a fastening ring may be produced, for example, from a rubber or plastic and be connected to the sleeves in a force-fitting, form-fitting and/or material-bonding manner.

In this embodiment, there is a relative movement of the two charge packs in their sleeves after detonation, as a result of the increasing pressure. Depending on the pressure development caused by the burning of the charge packs, they move away from each other in the axial direction along the carrying element until the delimiting elements reach their respective end stop elements. One advantage of this gas generator according to the invention is that the charge packs can be hermetically sealed before they are introduced into the well, so that a liquid or aggressive media that is/are optionally present in the well cannot get to the charge packs before detonation. A further advantage can be seen in that the solid fuel in the charge packs is largely protected from heat, which is advantageous particularly for deep wells, in which temperatures of about 150° C. are usually reached. As a result of the structural design of this embodiment, solid fuels that would not be possible when using caseless gas generators under the same operating conditions can be used. This increases the selection of solid fuels that can be used.

The two delimiting elements preferably have a circular cross section, the diameter being from 70 to 95%, particularly preferably from 75 to 90%, in particular from 80 to 85% of the well diameter. To be regarded as the relevant well diameter is the smallest diameter from the entry of the well at the Earth's surface into the perforation region in which the gas generator is to be used. In a strictly cylindrical well, the well diameter is substantially identical in the axial direction, in a conical well it usually decreases downwardly from the well entry, particularly in deep wells.

Choosing the cross section in the preferred ranges has the advantage that on the one hand the device can be easily introduced into a well by lowering, and on the other hand the propagation of the pressure as a result of the development of gas during the burning of the charge packs is restricted to the space between the two delimiting elements. When there is a larger diameter of the delimiting elements, there is the risk of canting of the gas generator during lowering into the well. When there is a smaller diameter, the annular gap between the delimiting element and the wall of the well is so great that significant amounts of gas escape through the annular gap, whereby the pressure in the space between the delimiting elements assumes lower values.

In a further preferred embodiment of a gas generator with two charge packs, provided between the charge packs in the axial direction is a container, which contains at least one liquid that is suitable for increasing the permeability of the rock in the perforation region. An example of such a liquid is hydrochloric acid in aqueous solution. The container is closed during the assembly of the gas generator and while it is being introduced into the well. It is designed in such a way that, after detonation of the charge packs, it is destroyed as a result of the pressure developing, and releases the liquid contained in it. This liquid is forced by the pressure into the perforation openings and contributes there to improving the permeability of the rock.

The gas generator according to the invention may be produced in advance and transported to the well in the completed state. It may, however, also be put together from prefabricated parts in situ before being introduced into the well. This procedure is appropriate in particular for the caseless versions. For example, in such a case the second delimiting element, the lower delimiting element in the axial direction, may firstly be connected to the carrying element by means of a fastening element. Subsequently, the individual charge units may be arranged on the carrying element, in that the carrying element is led through the axial clearances. A detonator may be mounted on a charge unit at the intended place and the lines for the detonator led upward through a cavity of the carrying element. Finally, the first delimiting element may be placed onto the uppermost charge unit and fixedly connected to the carrying element by means of a further fastening element. The finished gas generator is usually fastened to what is known as the logging cable by means of a suspension and is introduced into the well.

In a preferred embodiment of the method for well stimulation, a gas generator according to the invention is introduced into a well and positioned in such a way that the region of the gas generator in which most of the gas is emitted after detonation of the charge packs is at the level of the perforation region of the well.

In a further preferred embodiment, a gas generator which has an intermediate space between the charge packs in the axial direction is used. Before the charge packs are simultaneously detonated, the intermediate space between the charge packs in the well is filled with a liquid. Particularly preferably, this liquid is water. A well is often in any case filled with water from the reservoir, so that the filling of the intermediate space occurs automatically when the gas generator is introduced into the perforation region. In other cases, in which there is no water or insufficient water in the perforation region, a liquid can be charged through the well in order to fill the intermediate space of the gas generator. After detonation of the charge packs, the liquid located in the intermediate space is compressed as a result of the development of pressure and is forced into the perforation openings. The widening of the perforation channels is thereby assisted.

In a preferred development of the method according to the invention, the absolute pressure of the liquid in the well is increased before the detonation of the charge packs. A pressure increase may take place, for example, by a liquid, for example water, being charged into the well shortly before the detonation of the charge packs, until the desired pressure in the perforation region is reached. This procedure is preferably used if the region of the rock near the well is not very permeable. In this case, the maximum pressure that can be reached in the perforation region is limited by the hydrostatics of the liquid column in the well.

The gas generator according to the invention makes it possible to specifically widen perforation openings in a production zone, without thereby damaging the lining of the well. This contributes to increasing reliability, in particular under geologically difficult conditions such as high reservoir temperatures. The burning of the solid fuel charges in the direction of the delimiting elements has the effect of maintaining a high pressure in a restricted space, which has the result that existing perforation openings are widened or new perforation openings are formed. The method can also be used for gas reservoirs with low permeability, or in cases in which water-bearing layers or other factors restrict the use of the known hydrofracing.

If water is present in the region of the perforation openings, the burning of the solid fuel in both directions brings about a compression of the volume of water that is located between the charges. This creates a pressure in the perforation region that exceeds that of hydrofracing. This causes cracks in an area of several meters around the well. This positive effect can be further enhanced by increasing the water pressure in the well before the detonation of the charges. The method according to the invention consequently contributes to increasing the efficiency and productivity and can be advantageously used both for injection wells and for production wells.

The gas generator according to the invention is distinguished by a simple construction that can be produced inexpensively. Essential parts such as the carrying element and the delimiting elements, and possibly the sleeves, are suitable for reuse as a result of their material properties, this likewise contributing to cost savings.

Figure 2:
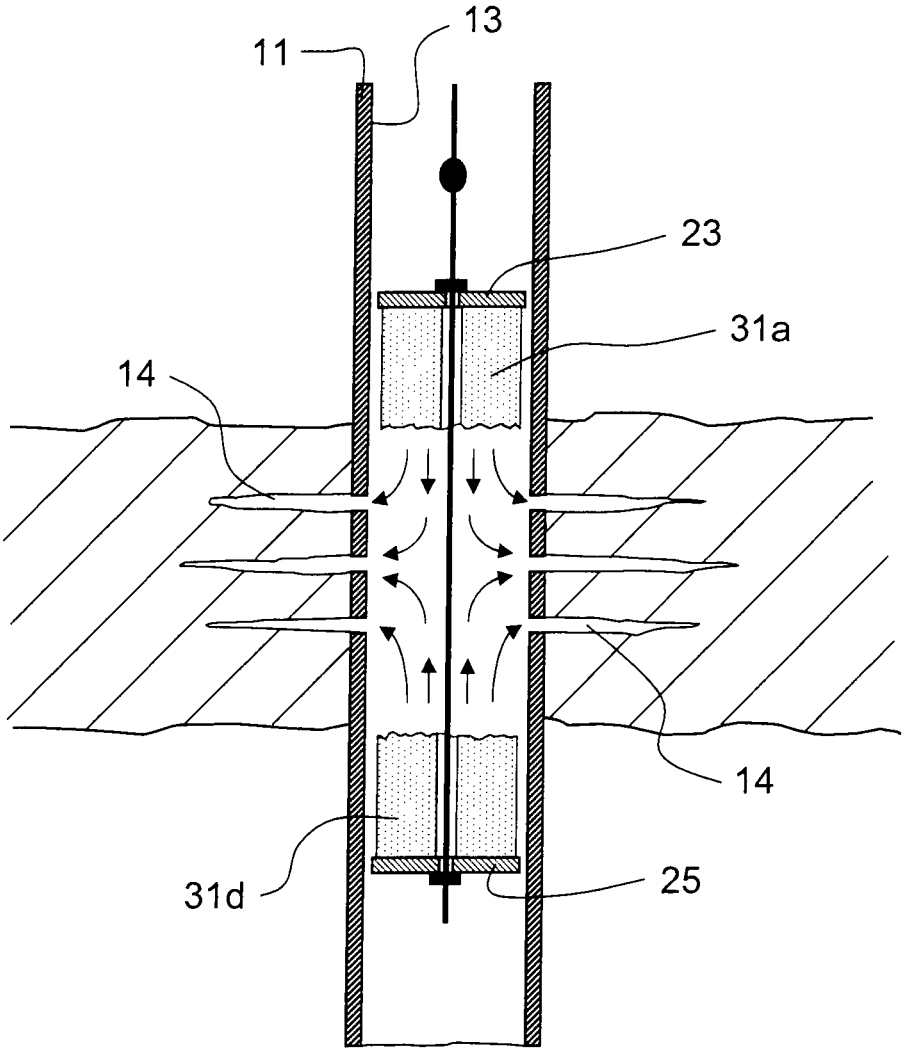
Figure 3:
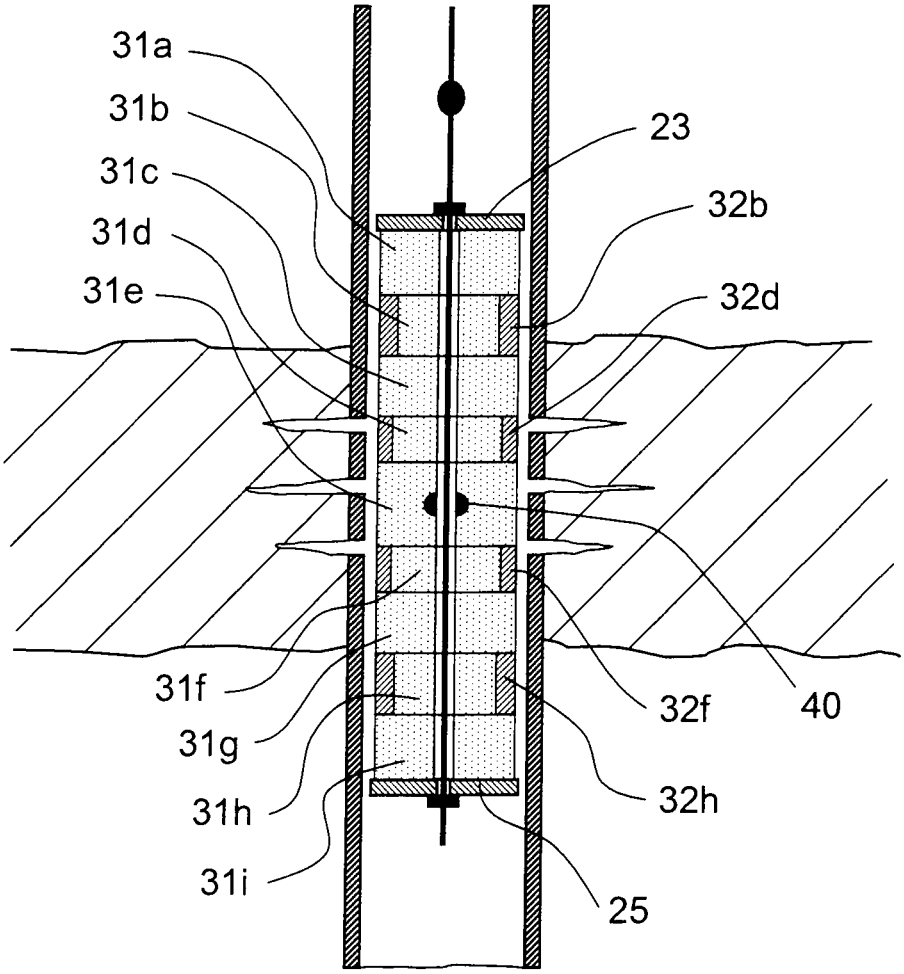
Figure 4:
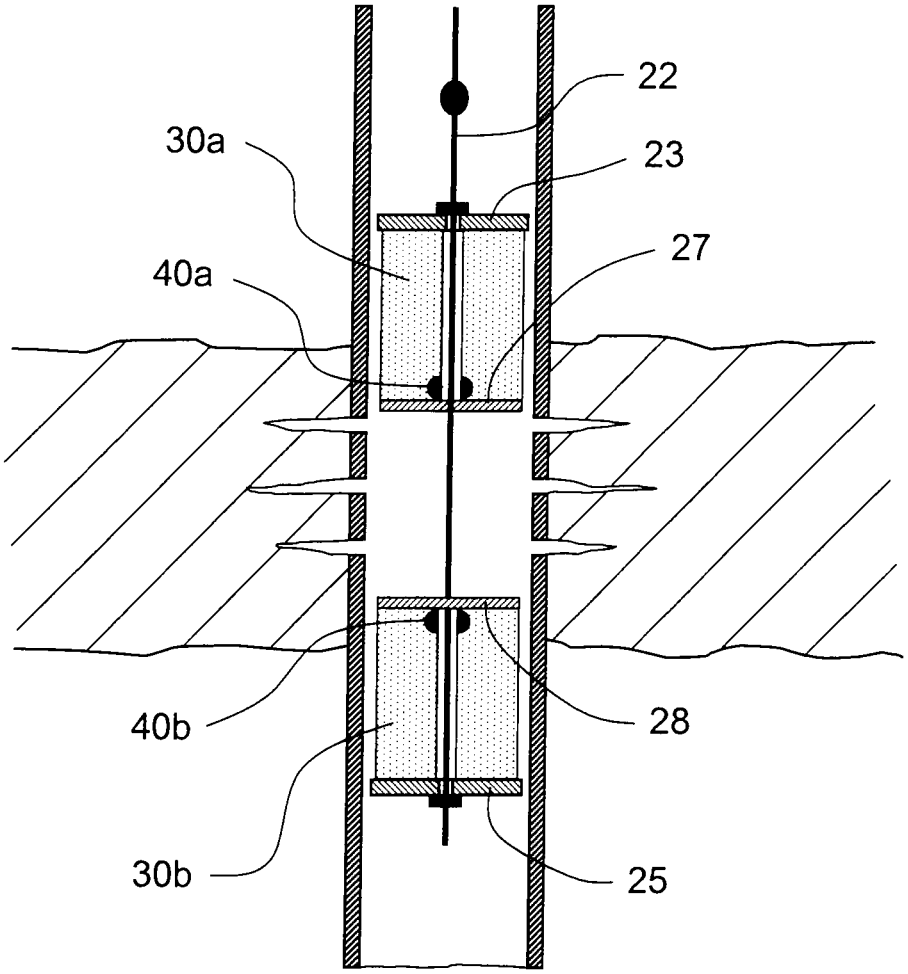
Figure 5:
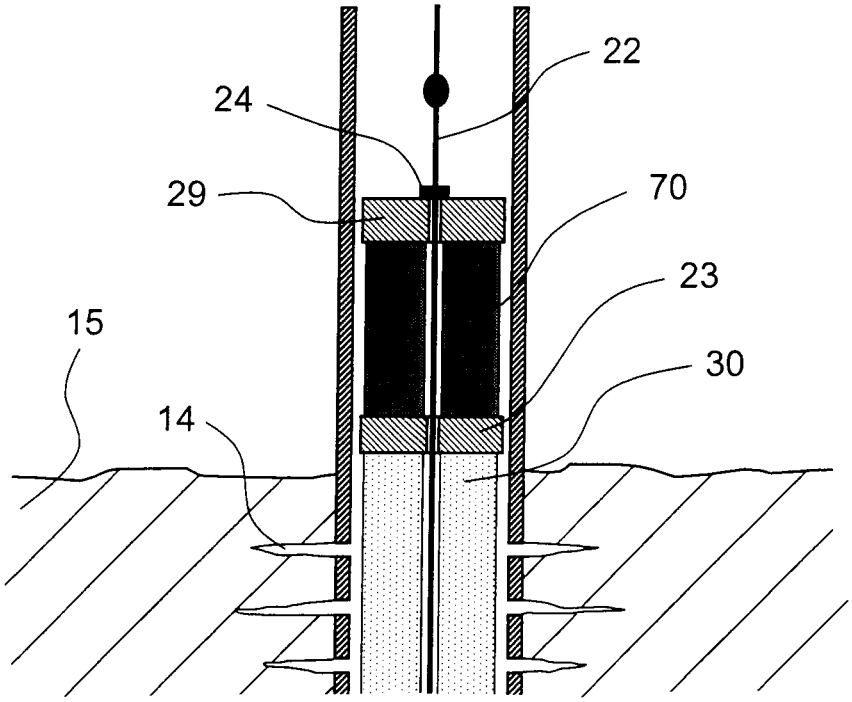
Figure 6:
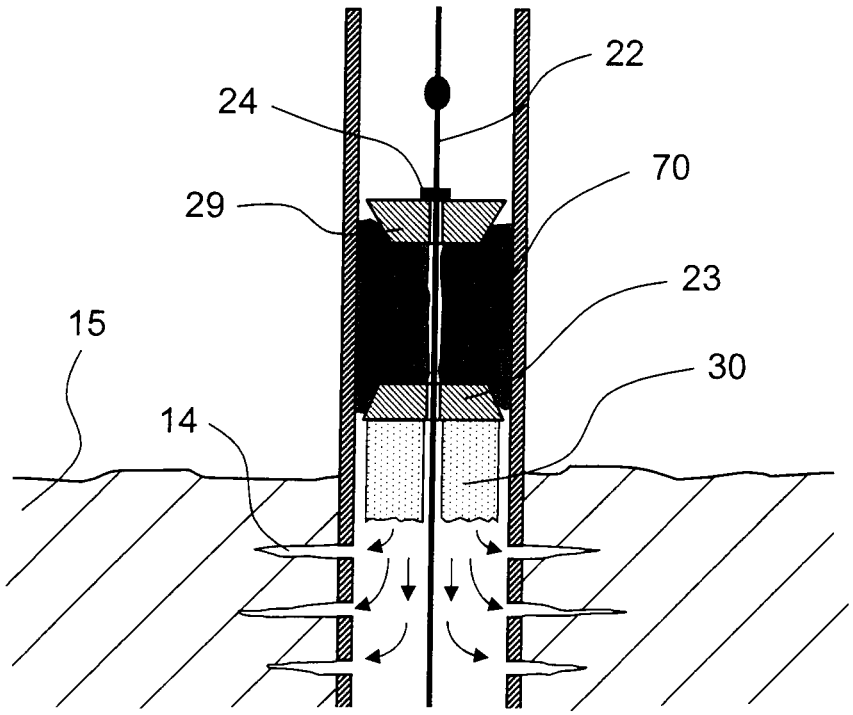
Figure 7:
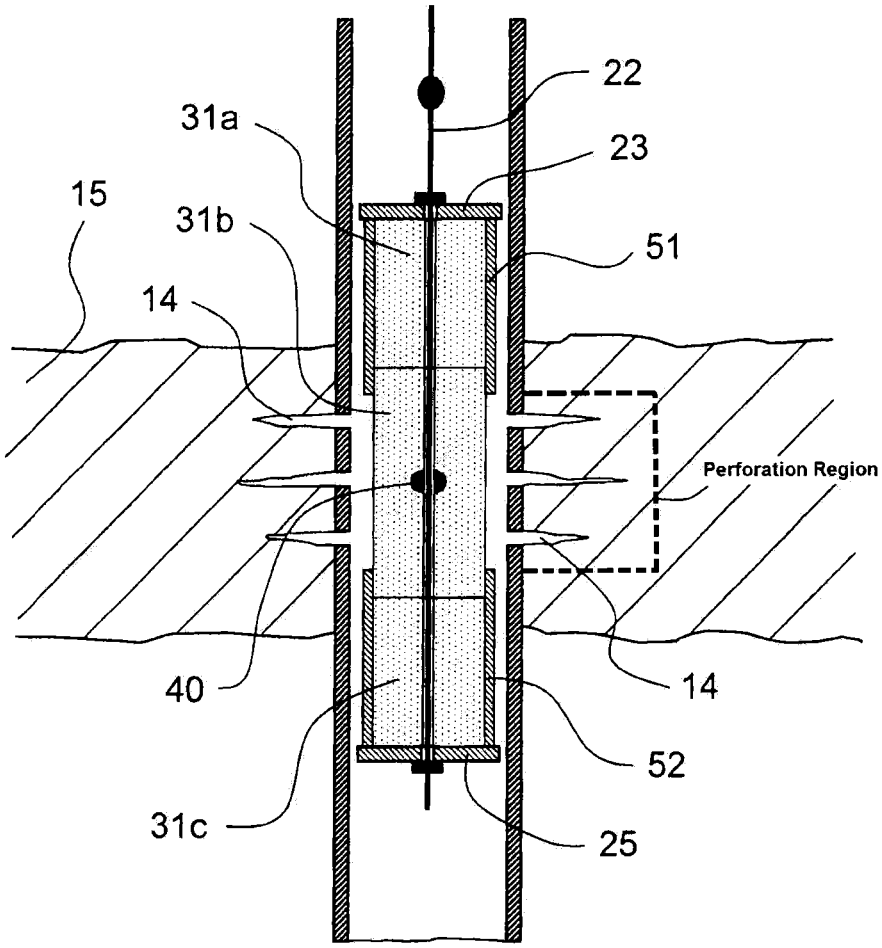
Figure 8:
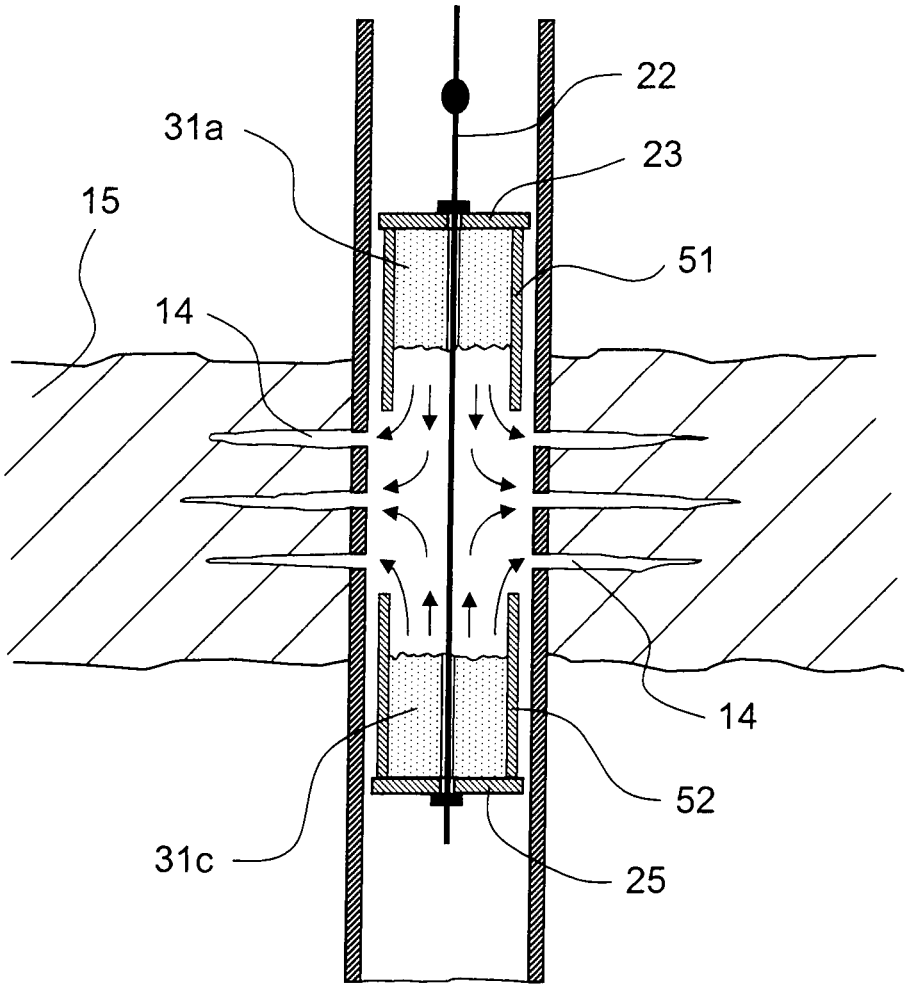
Figure 9:
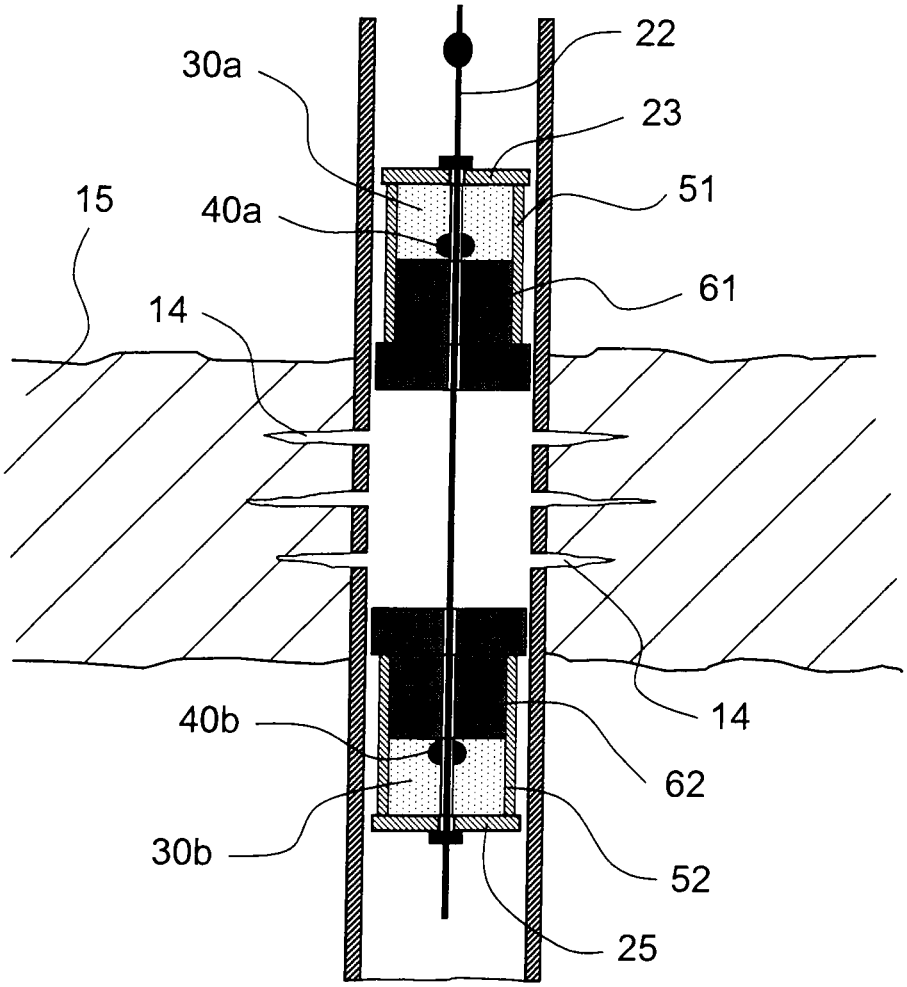
Figure 10:
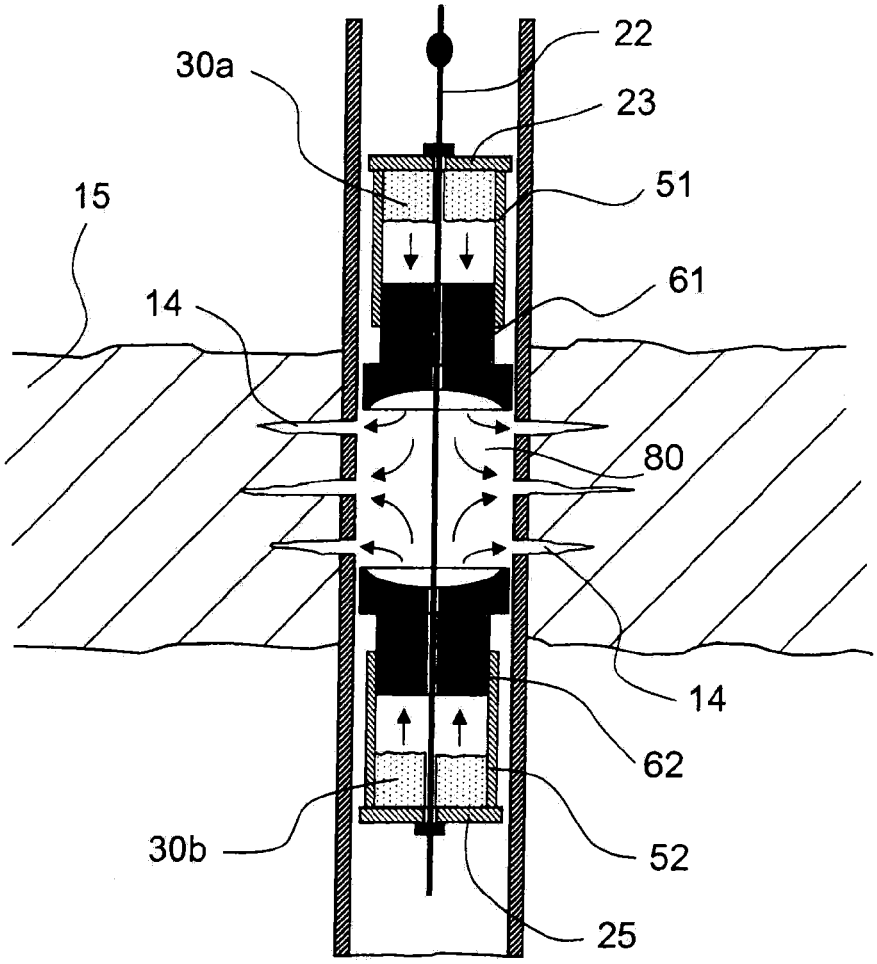
Figure 11:
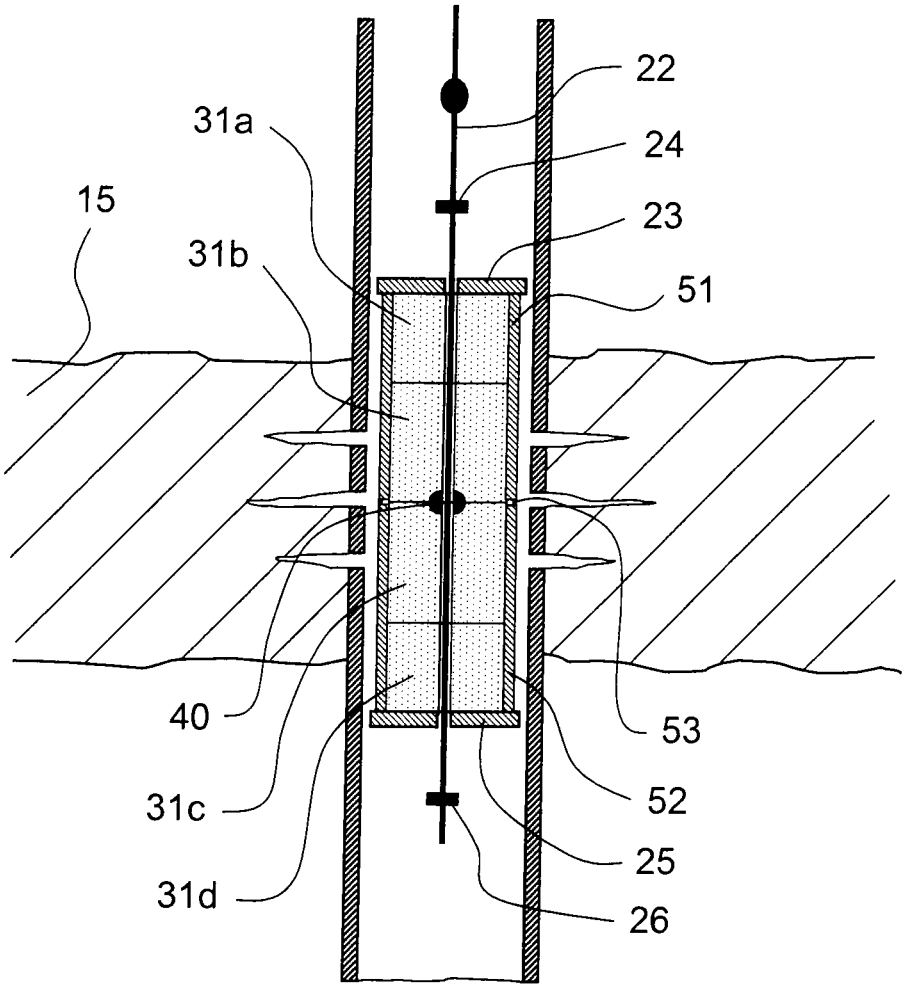
Figure 12:
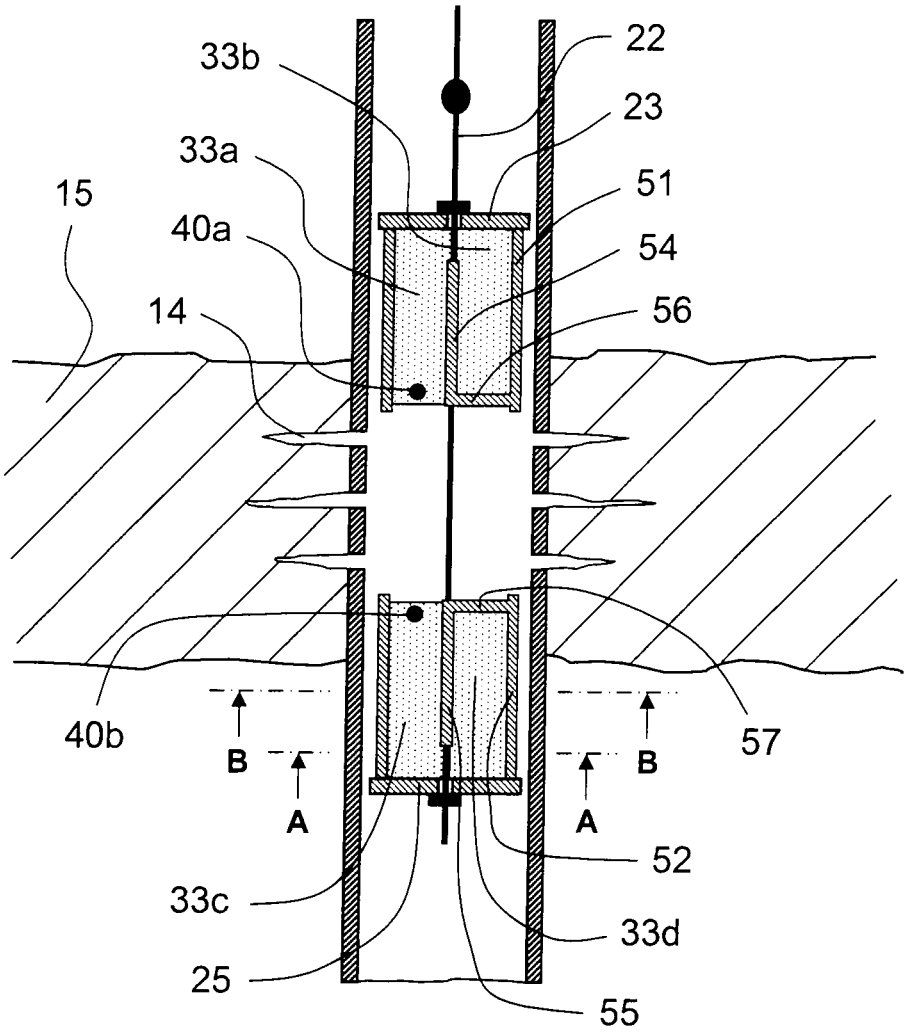
Figure 13:
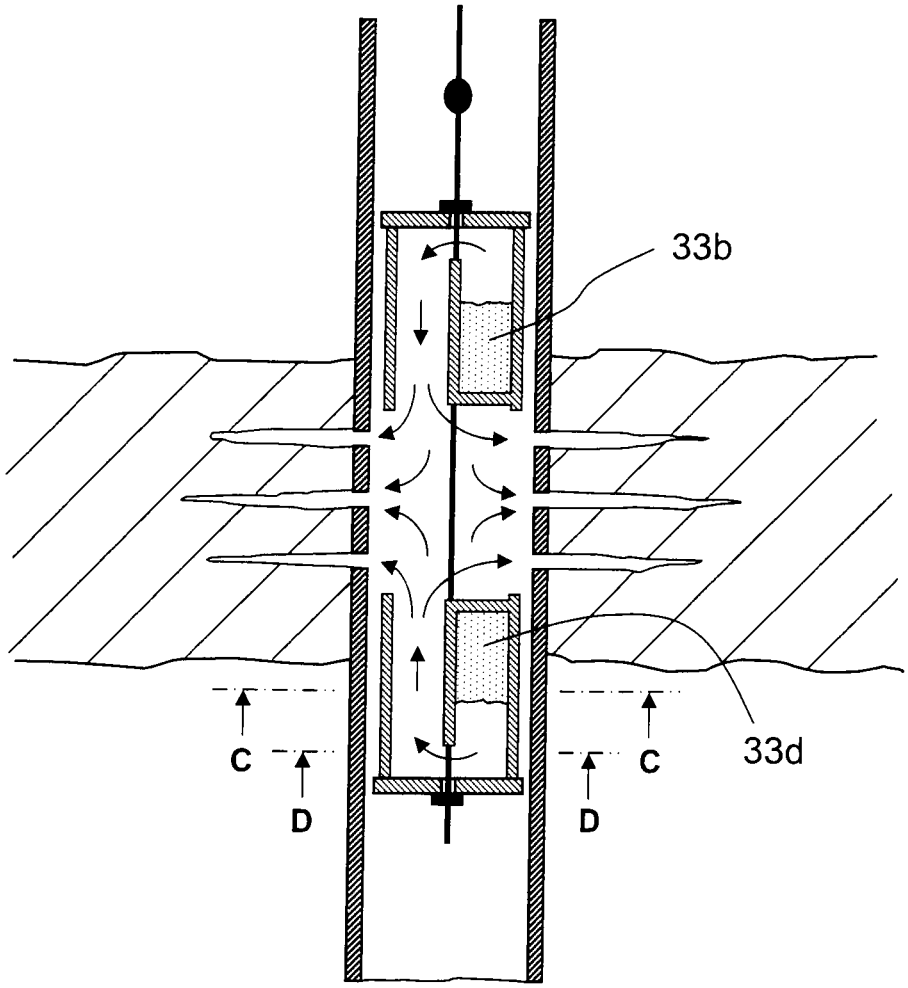
Figure 14:
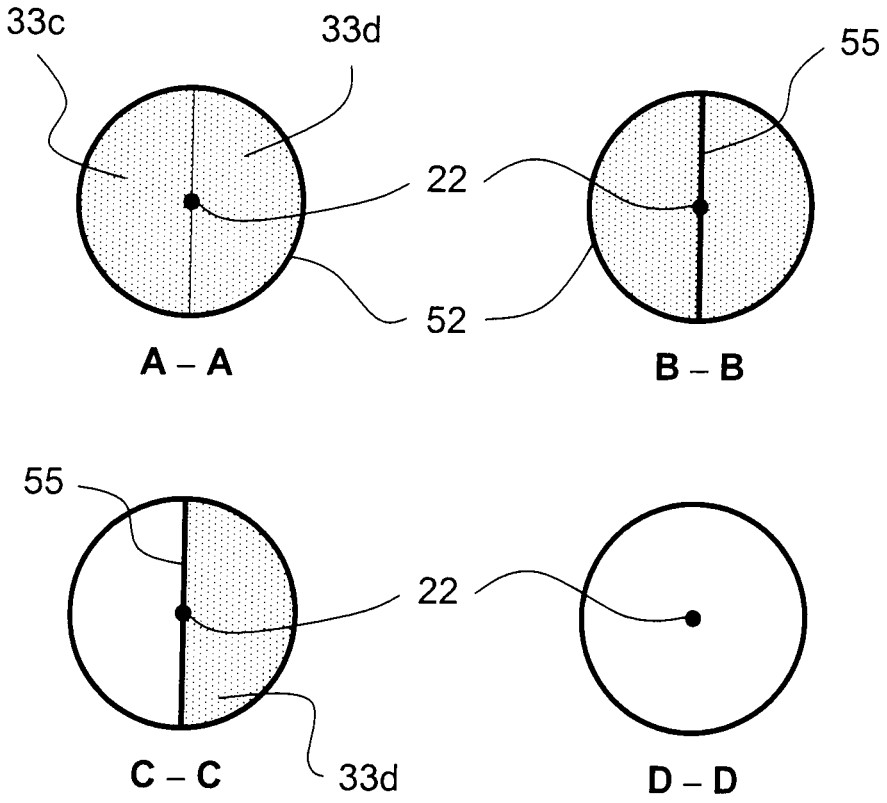
Figure 15:
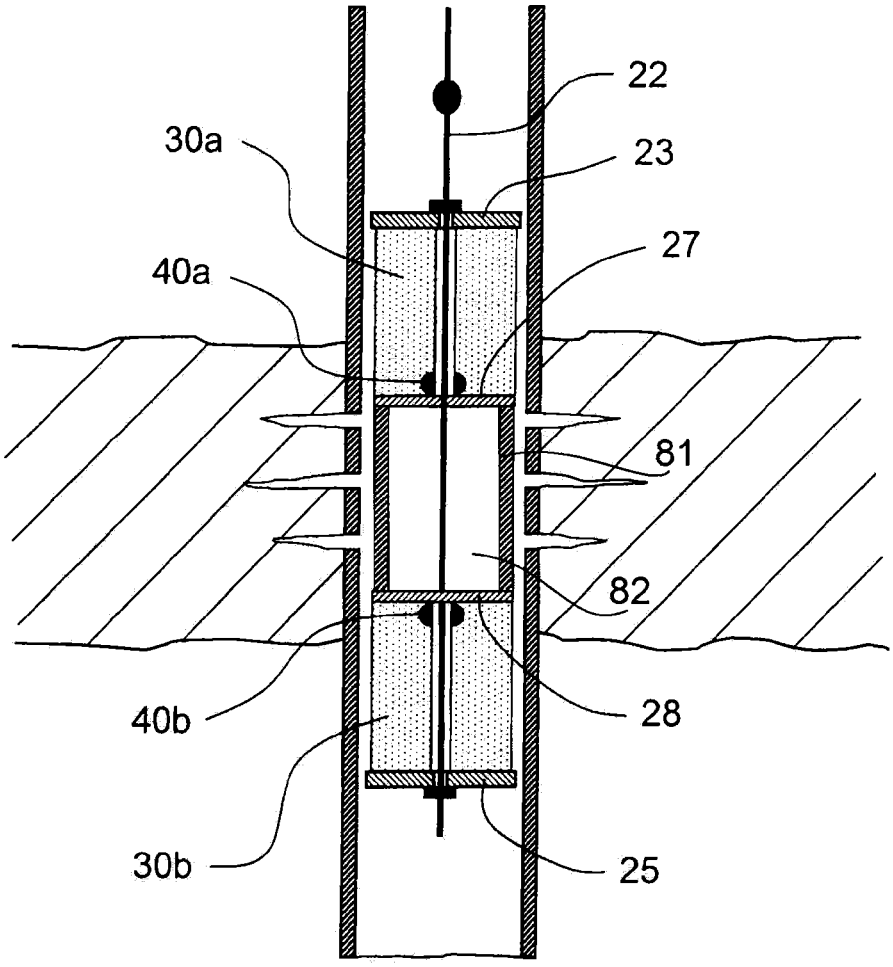

The invention is further explained below on the basis of the drawings, which are to be understood as basic representations. They do not restrict the invention, for example with regard to actual dimensions or configurational variants of components. For the sake of better presentation, they are generally not to scale, in particular with regard to relative lengths and widths. In the drawings:

FIG. 1 shows an embodiment of a caseless gas generator according to the invention, FIG. 2 shows a caseless gas generator according to the invention during the burning process, FIG. 3 shows an embodiment of a caseless gas generator according to the invention with different diameters of neighboring charge units, FIG. 4 shows an embodiment of a caseless gas generator according to the invention with charge packs spaced apart from one another, FIG. 5 shows an embodiment of a caseless gas generator according to the invention with a sealing pack, FIG. 6 shows a caseless gas generator according to the invention with a sealing pack during the burning process, FIG. 7 shows an embodiment of a gas generator according to the invention with a case, FIG. 8 shows a gas generator according to the invention with a case during the burning process, FIG. 9 shows an embodiment of a gas generator according to the invention with a case and a pressure piston, FIG. 10 shows an embodiment of a gas generator according to the invention with a case and a pressure piston with a concave end face during the burning process, FIG. 11 shows an embodiment of a gas generator according to the invention with a case and an outer sheath that is closed before the detonation, FIG. 12 shows an embodiment of a gas generator according to the invention with a case and a dividing wall in the case, FIG. 13 shows a gas generator according to the invention with a case and a dividing wall during the burning process, FIG. 14 shows cross sections of the embodiment according to FIGS. 12 and 13, FIG. 15 shows an embodiment of a gas generator according to the invention with a container.

LIST OF DESIGNATIONS USED

10 . . . well
11 . . . lining
12 . . . perforation openings
13 . . . inner wall of the lining
14 . . . perforation channels
15 . . . production zone
20 . . . logging cable
21 . . . suspension of the carrying element
22 . . . carrying element
23 . . . first delimiting element
24 . . . first fastening element
25 . . . second delimiting element
26 . . . second fastening element
27 . . . first fixing element
28 . . . second fixing element
29 . . . additional delimiting element
30 . . . charge pack
31 . . . charge unit
32 . . . annular encasing around charge unit
33 . . . solid fuel filling
40 . . . detonator
51 . . . first sleeve
52 . . . second sleeve
53 . . . connection between the sleeves
54 . . . dividing wall of the first sleeve
35 . . . dividing wall of the second sleeve
56 . . . covering of the first sleeve
57 . . . covering of the second sleeve
61 . . . first pressure piston
62 . . . second pressure piston
70 . . . sealing pack
80 . . . liquid in well
81 . . . container
82 . . . liquid Structurally identical elements that an embodiment comprises more than once are distinguished by the same designations with appended letters, for example charge packs 30*a* and 30*b*, charge units 31*a* to 31*i*, solid fuel fillings 33*a* to 33*d*, detonators 40*a* and 40*b*.

FIGS. 1 to 9 represent schematic sectional drawings of a well 10 in an underground reservoir. The well 10 is provided with a lining 11, for example a steel pipe. The lining 11 prevents loose rock in the area of the well from falling into the well and large quantities of usually pressurized formation fluids such as formation water from breaking into the well. The lining 11 has a number of perforation openings 12. Perforation channels 14 are created in the production zone 15 by known methods such as gun perforation or jet perforation. By way of the perforation channels 14, fluids to be extracted, for example natural gas or mineral oil, flow through the perforation openings 12 into the well and can be taken to the surface.

The inner wall 13 of the lining 11 is of a cylindrical or stepwise cylindrical configuration with a circular cross section. In a stepwise cylindrical configuration, the diameter of the circular cross section is reduced in steps downwardly in the axial direction. The carrying element 22 of the gas generator is connected by way of a suspension 21 to the logging cable 20, which can be moved to the surface by means of a winch. The latter is not represented in the figures; corresponding devices are known to a person skilled in the art.

FIG. 1 shows an embodiment of a caseless gas generator according to the invention. A plate is fixedly attached as a first delimiting element 23 to the carrying element 22 by means of a first fastening element 24. At the lower end of the carrying element 22, a further plate is fixedly attached as a second delimiting element 25 by means of a second fastening element 26. Arranged between the two delimiting elements 23, 25 is a charge pack 30, which in FIG. 1 has been put together from four individual charge units 31*a*, 31*b*, 31*c* and 31*d*. The charge units are configured as cylinders with an axial clearance, through which the carrying element 22 is led. Provided centrally in the axial direction is a detonator 40, which during detonation causes the neighboring charge units 31*b* and 31*c* to burn.

The axial extent of the production zone 15 depends on the geological conditions and is typically in a range from 1 to 30 m, extents of less than 1 m or more than 30 m also being possible. FIG. 1 represents a preferred embodiment of a gas generator, in which the length of the charge pack 30 is greater than the axial extent of the production zone 15. The gas generator is arranged in such a way that the point that lies midway between the two delimiting elements 23 and 25 in the axial direction corresponds approximately to the center of the axial extent of the perforation openings 12. In production zones with an axial extent of the perforation region of more than 20 m, it may be advisable for reasons of handling during assembly and introduction into the well to use gas generators in which the length of the charge pack is less than the axial length of the production zone. In such a case, the production zone would be treated section by section.

When the charge pack is detonated, the charge units burn from the middle upward and downward in the direction of the delimiting elements 23, 25. This situation is schematically represented in FIG. 2. The burning produces a large amount of gas, which spreads in all directions. The fact that the annular gaps between the respective delimiting element 23, 25 and the inner wall 13 of the lining 11 are narrow and only allow little gas to pass through has the effect that gas is forced into the already existing perforation channels 14. These are thereby widened and cleaned of deposits. Depending on the level of the pressure and the properties of the rock, new channels also form or existing channels become branched. The burning duration of the charge units depends on the chemical composition of the solid fuels actually used and the overall length of the charge pack. It may vary between a few seconds and several minutes. In the design of the charge packs, a compromise is often necessary between obtaining fast, efficient burning on the one hand and largely avoiding damage to the well or its lining, as a result of the development of excessive pressure, on the other hand.

The way in which the pressure develops during the burning can be influenced by using a number of charge units with different diameters. FIG. 3 shows such an example in which nine charge units 31*a* to 31*i* are arranged between two delimiting elements 23, 25. The charge units 31 have different diameters and lengths in the axial direction. In the actual example, the charge units are symmetrical in relation to the middle charge unit 31*e* in the axial direction, i.e. the charge units 31*a* and 31*i*, 31*b* and 31*h*, 31*c* and 31*g* as well as 31*d* and 31*f* are respectively configured identically in pairs. The detonator 40 is attached centrally in the charge unit 31*e*. After detonation, the charge units burn as shown in the example of FIG. 2 from the middle outward in the direction of the delimiting elements 23, 25. The burning of charge units with smaller diameter produces a smaller amount of gas, and consequently a smaller pressure, than the burning of charge units with greater diameter. This allows pressure pulsations to be specifically generated. The annular encasings 32*b* to 32*h* enhance this effect.

The pressure pulses of the gases bring about a resonant oscillation in the perforation region of the production zone, which is conducive to the relaxation of zones with relatively high orogenic pressure in the production zone, the opening of cracks and improvement in the permeability in the region of the well. Selection of the parameters such as the diameter and length of the charge units as well as their arrangement in the axial direction between the delimiting elements allow the pulsed burning of the charges to be optimized.

FIG. 4 illustrates a gas generator according to the invention with charge packs 30*a* and 30*b* spaced apart from each other. A first charge pack 30*a*, which in this case comprises only one charge unit, is arranged between the first delimiting element 23 and a first fixing element 27. A second charge pack 30*b*, which likewise comprises only one charge unit, is arranged between the second delimiting element 25 and a second fixing element 28. The fixing elements 27, 28 are fastened to the carrying element 22 and serve the purpose of securing the charge packs against falling out or slipping along the carrying element 22. They are produced from a material which decomposes during the burning of the charges, for example from a plastic such as polyethylene, polypropylene or polyamide. They may also be produced from a fuel, for example a combustible plastic.

The axial spacing between the fixing elements 27 and 28 is preferably chosen such that it is not greater than the axial extent of the perforation region in the production zone. The gas generator is preferably placed in the well in such a way that the perforation openings are located in the region of the intermediate space between the fixing elements 27, 28, and consequently not in the region of direct influence of the charge packs. Each charge pack 30*a*, 30*b* is provided with its own detonator 40*a*, 40*b*, which are connected in signaling terms in such a way that they can be detonated simultaneously. After simultaneous detonation of both charge packs, they burn in the direction of the respective delimiting elements 23, 25, so that a burning process the same as that represented in FIG. 2 is obtained. The development of pressure has the effect that existing perforation channels widen or new ones form. This effect can be enhanced if in the intermediate space between the charge packs there is a liquid, for example water, which is forced by the developing pressure into the perforation openings in the production zone.

In FIG. 5 and FIG. 6, embodiments of a gas generator according to the invention with a sealing pack are represented, only the upper part of the gas generator being depicted in each case for reasons of overall clarity. FIG. 5 shows the situation before the detonation. Attached on the charge pack 30 is the first delimiting element 23, which in this example is formed as a cylindrical plate and the outer diameter of which is greater than the outer diameter of the charge pack 30. Arranged above the first delimiting element 23 is a sealing pack 70, which comprises a flowable solid material, for example compressed sand. On top of the sealing pack 70 there is an additional delimiting element 29, which is likewise formed as a cylindrical plate. This is fixedly connected to the carrying element 22 by means of the first delimiting element 24.

FIG. 6 shows the situation during the burning process of the charge pack 30. In this example, the first delimiting element 23 and the additional delimiting element 29 are produced in the form of a truncated cone, for example from solid high-strength steel. The charge pack 30 and the first delimiting element 23 are attached to the carrying element 22 movably in the axial direction. After detonation of the charge pack 30, the latter burns, producing gas. As a result of the accompanying increase in pressure, the charge pack 30 moves with the first delimiting element 23 in the direction of the additional delimiting element 29. At the same time, the sealing pack 70 is compressed in the axial direction, which has the consequence that the flowable solid material escapes radially to the side. The solid material is also forced into the annular spaces between the delimiting elements 23, 29 and the inner wall of the well, which is indicated by the dashed arrows in FIG. 6. As a result of the friction of the solid material and the formation of the delimiting elements 23, 29, flowing out of the solid material in the direction of the charge pack 30, or upwardly by way of the additional delimiting element 29, is largely avoided.

The flowable solid material fills the entire cross section of the well and thereby forms a seal, which prevents the gas occurring from escaping from the space around the charge pack 30.

The use of a sealing pack 70 consequently contributes to increasing the pressure during the burning of the solid fuel, which has advantageous effects on the efficiency of the well stimulation.

FIG. 7 shows a first embodiment of a gas generator according to the invention with a case. A charge pack with three charge units 31*a*, 31*b*, 31*c* is arranged between the first delimiting element 23 and the second delimiting element 25. In the center of the middle charge unit 31*b* there is a detonator 40 for detonating the charge pack. A first cylindrical sleeve 51 completely encloses the charge pack in the radial direction. It is fastened in such a way that it provides a gastight termination in the axial direction with the first delimiting element 23. A second cylindrical sleeve 52 completely encloses the charge pack on the opposite side in the radial direction. It is fastened in such a way that it provides a gastight termination in the axial direction with the second delimiting element 25. The two not-closed ends of the first sleeve 51 and the second sleeve 52 are facing each other. The sleeves 51, 52 are produced from a material which is not destroyed during the burning of the charge pack, for example from a high-strength toughened steel.

In the embodiment according to FIG. 7, the two open ends are spaced apart from each other in the axial direction, so as to create an intermediate space in which the charge pack is not enclosed by a sleeve in the radial direction. Before the detonation of the charge pack, the gas generator is advantageously placed in the well in such a way that, in the axial direction, the center of the intermediate space between the open ends of the sleeves 51, 52 corresponds approximately to the center of the region of the perforation channels 14 of the production zone 15. In a further advantageous configuration, the length of the intermediate space between the open ends of the sleeves 51, 52 corresponds substantially to the length of the region of the perforation channels 14 of the production zone 15.

After the detonation, the charge units burn, from the detonator 40 respectively in the direction of the delimiting elements 23, 25, in a way comparable to the representation in FIG. 2. The difference from the caseless embodiment described above is that the development of gas is concentrated by the sleeves 51, 52 on the intermediate space between the sleeves. This is illustrated by the representation in FIG. 8. The local concentration on this region allows a constantly higher pressure level to be achieved throughout the duration of the burning. The local concentration also brings about the effect that the well or its lining is only exposed to the high pressures to a limited extent and the other regions, for example outside the perforation region, are protected from possible damage.

In FIG. 9, an embodiment of the gas generator according to the invention with a case and a pressure piston is represented. A first delimiting element 23 is connected in a gastight manner to a first sleeve 51 and is fastened to the carrying element 22. Inside the first sleeve 51 there is a first charge pack 30*a*, which is provided at its lower end with a detonator 40*a*. Also arranged in the sleeve 51 is a first pressure piston 61, the upper end of which reaches up to the charge pack 30*a* and which is movable along the carrying element 22. In the axial direction, the pressure piston 61 protrudes beyond the open end of the sleeve 51. The outer diameter of the pressure piston 61 is greater in this region than the outer diameter of the sleeve 51. By analogy, a second pressure piston 62 is movably attached in a second sleeve 52. The end faces of the two pressure pistons 61, 62 are spaced apart from each other, the actual spacing being chosen in dependence on the perforation region.

FIG. 10 shows a further embodiment of the gas generator according to the invention with a case and a pressure piston, in a state after the detonation of the charge packs. As a difference from the embodiment according to FIG. 9, the end faces in this example are of a concave form. As a result of the development of gas during the burning process, the pressure pistons 61, 62 are forced in the direction of the open end of the respective sleeve 51, 52. The intermediate space between the end faces is filled with a liquid. There is often a liquid 80 already in the well before the gas generator is introduced, for example when there is water from the reservoir. If there is no liquid or insufficient liquid, it may also be filled by way of the well. The two pressure pistons 61, 62 generate pressure waves, which collide in the intermediate space and trigger pressure waves which extend into the perforation channels 14. This type of well stimulation is very effective with regard to the widening and new formation of perforation channels 14.

FIG. 11 shows a further embodiment of the gas generator according to the invention with a case. The first delimiting element 23 is connected in a gastight manner to a first sleeve 51. The sleeve 51 encloses a first charge pack, which in the example represented comprises two charge units 31*a*, 31*b*. The second delimiting element 25 is connected in a gastight manner to a second sleeve 52. This encloses a second charge pack, which likewise comprises two charge units 31*c*, 31*d*. Sleeves 51, 52 and charge units 31*a*, 31*b*, 31*c*, 31*d* are dimensioned such that there is only a small spacing between the open ends of the sleeves. The opposing charge units 31*b* and 31*c* of the two charge packs may be spaced apart from each other or touch each other. However, they are not fixedly connected to each other.

The two sleeves 51, 52 are fastened to each other by way of the intermediate space between the open ends. The connection 53 between the sleeves may take place for example by spot welding. The connection 53 may also be ensured by a connecting element which, as a result of its material properties or material thickness, fails under a defined pressure, so that the connection is released. An example of this is a thin fastening ring, which may be produced from a rubber or plastic and be connected to the sleeves in a force-fitting, form-fitting and/or material-bonding manner.

As a difference from the embodiment according to FIG. 7, in the present case the delimiting elements 23, 25 are not in contact with their respective fastening elements 24, 26 in the starting position. The delimiting elements 23, 25 with the sleeves and charge packs fastened to them are movably attached to the carrying element 22. This can be achieved, for example, by clamps on the delimiting elements 23, 25, which apply a certain retaining force. The retaining force is chosen such that it is adequate to prevent slipping during the introduction of the gas generator into the well, but not sufficient to withstand the pressure during the burning process.

The detonator 40 is arranged in such a way that during detonation both the first charge pack and the second charge pack are detonated. After the detonation, the connection 53 is destroyed by the development of gas and the increase in pressure caused as a result, and the two charge packs move in their sleeves axially along the carrying element 22 in the direction of their respective fastening elements 24, 26. These serve as end stops, which stop the movements of the charge packs and limit the spacing between the sleeves to a predetermined amount. The fastening elements 24, 26 are advantageously arranged in such a way that the spacing between the open ends of the sleeves is not greater than the perforation region.

In the starting position before the detonation, the gas generator is placed in the well in such a way that, after the charge packs have moved apart, the center of the intermediate space between the sleeves 51, 52 in the axial direction is approximately in the middle of the region of the perforation channels 14 of the production zone 15. The situation of further burning of the charge packs corresponds to that shown in FIG. 8.

The embodiment according to FIG. 11 may be advantageously used if the charge packs are to be protected from external influences that could damage them, for example aggressive waters present in the well or high temperatures in hot wells. For use in hot wells, the gas generator according to the invention can be further improved by the sleeves being provided with an insulation against thermal radiation on the inside or outside in the radial direction.

In FIG. 12, a further embodiment of a gas generator according to the invention with a case is represented. A first sleeve 51 is fastened in a gastight manner to the first delimiting element 23. The sleeve 51 is provided inside with a dividing wall 54, which extends in the axial direction from the open end in the direction of the delimiting element 23 and divides the sleeve into two chambers. Between the delimiting element 23 and the dividing wall 54 there is a spacing, so that the chambers in the sleeve 51 are connected. The spacing is chosen such that the area over which the chambers are connected corresponds substantially to the cross-sectional area of the individual chambers. The chamber of the first sleeve 51, represented on the right in the example of FIG. 12, is closed at the end opposite from the delimiting element 23 by a covering 56.

By analogy, a second sleeve 52 is fastened in a gastight manner to the second delimiting element 25. The sleeve 52 is provided inside with a dividing wall 55, which extends in the axial direction from the open end in the direction of the delimiting element 25 and divides the sleeve into two chambers. Between the delimiting element 25 and the dividing wall 55 there is a spacing, so that the chambers in the sleeve 52 are connected. The spacing is chosen such that the area over which the chambers are connected corresponds substantially to the cross-sectional area of the individual chambers. The chamber of the second sleeve 52, represented on the right in the example of FIG. 12, is closed at the end opposite from the delimiting element 25 by a covering 57. The half-closed ends of the first sleeve 51 and the second sleeve 52 are facing each other.

The chambers of the sleeves are filled with a solid fuel, for example ballistite powder. As in the previous examples, the sleeves are produced from a material which is not destroyed during the burning of the solid fuel. In the example represented in FIG. 12, the chambers that are closed at the ends are completely filled with solid fuel fillings 33*b*, 33*d*. Similarly, the chambers that are open at the ends are completely filled with solid fuel fillings 33*a*, 33*c*. In each sleeve, a detonator 40*a* or 40*b* is respectively attached on the open side of the chamber. The detonators 40*a*, 40*b* may be activated in such a way that the respective solid fuel fillings 33*a* and 33*c* are detonated simultaneously or one after the other in time.

After the detonation, first the solid fuel fillings 33*a*, 33*c* in the chambers that are open at the ends burn in the direction of their respective delimiting elements 23, 25. As soon as the end of the respective dividing wall 54, 55 is reached, the solid fuel fillings 33*b*, 33*d* in the chambers that are closed at the ends are also detonated and burn in the direction of the coverings 56, 57. FIG. 13 schematically represents a situation in which the solid fuel fillings 33*b*, 33*d* in the chambers that are closed at the ends have already burned partly.

In FIG. 14, cross sections through the second sleeve 52 are represented, identified in FIGS. 12 and 13 by A-A to D-D. The section A-A lies axially in the region of the intermediate space between the dividing wall 55 and the second delimiting element 25 and represents the state before detonation, in which there is still a solid fuel filling 33*c*, 33*d* in both chambers of the sleeve. The section B-B lies axially in the region of the dividing wall, which in the present example divides the cross section of the sleeve into two parts of equal size. Section C-C corresponds with respect to position to the section B-B, but shows the situation in which the solid fuel filling 33*b* of the chamber that is open at the end has already burned. Section D-D likewise shows this situation and corresponds in its axial position to the section A-A.

In FIG. 15, a gas generator with two charge packs is shown, and provided between the charge packs in the axial direction is a container 81, which contains at least one liquid 82 that is suitable for increasing the permeability of the rock in the perforation region. An example of such a liquid is hydrochloric acid in aqueous solution. The container is closed during the assembly of the gas generator and while it is being introduced into the well. It is designed in such a way that, after detonation of the charge packs, it is destroyed as a result of the pressure developing, and releases the liquid contained in it. This liquid is forced by the pressure into the perforation openings and contributes there to improving the permeability of the rock.

The invention claimed is:

1. A device suitable for well stimulation, comprising:

a carrying element with a first delimiting element and a second delimiting element, also at least one charge pack, which comprises one or more charge units of a solid fuel, and also at least one detonator to detonate the at least one charge pack, the charge pack or the charge packs being arranged on the carrying element between the delimiting elements, wherein the one or more charge units are configured as cylinders with a continuous axial clearance, and the carrying element is formed as a rod or cable and is led through the continuous axial clearance, so that the carrying element passes through an entire axial length of all the cylinders, and the carrying element is produced from a material which is not destroyed during burning of the at least one charge pack.

2. The device according to claim 1, wherein neighboring charge units have different outer diameters.

3. The device according to claim 2, wherein smaller outer diameters have values in a range from 75% to 95% of a greatest outer diameter, and an axial extent of the charge units with reduced outer diameter is from 10% to 50% of an axial extent of the charge units with non-reduced outer diameter.

4. The device according to claim 1, wherein an entire space between the delimiting elements in an axial direction is filled with a charge pack, and the detonator or detonators is or are arranged in such a way that, during detonation, the burning of the at least one charge pack begins in a middle region in the axial direction and continues in a direction of the first and second delimiting elements.

5. The device according to claim 1, comprising two charge packs, the two charge packs being arranged spaced apart from each other on the carrying element and on or in each charge pack there is at least one detonator, so that the charge packs can be detonated simultaneously or one after the other in time.

6. The device according to claim 1, the device also comprising at least one sealing pack of free-flowing solid material and at least one additional delimiting element, which is attached to the carrying element outside an intermediate space between the first delimiting element and the second delimiting element in an axial direction, and the sealing pack being arranged between the additional delimiting element and the first or the second delimiting element.

7. The device according to claim 1, which also comprises two sleeves, which are produced from a material which is not destroyed during the burning of the charge packs, the sleeves enclosing the charge packs in a radial direction, the first sleeve being attached by one end in a gastight manner to the first delimiting element, the second sleeve being attached by one end in a gastight manner to the second delimiting element, and the other ends respectively of the sleeves facing each other.

8. The device according to claim 7, wherein two open ends of the sleeves are spaced apart from each other, a charge pack, which butts against the respective delimiting element and only partially fills the sleeve in an axial direction also is present in both sleeves, and a pressure piston is attached movably in the axial direction in each sleeve, protruding beyond the open end of the respective sleeve and having an outer diameter which is greater than an inner diameter of the respective sleeve at its open end.

9. The device according to claim 7, wherein a spacing between the mutually facing ends of the sleeves in an axial direction is at most as great as an axial extent of a perforation region in a well.

10. The device according to claim 1, which also comprises a first end stop element and a second end stop element, which are both fixedly connected to the carrying element, the delimiting elements being attached to the carrying element axially displaceably in an axial direction between the end stop elements.

11. The device according to claim 1, wherein the delimiting elements in each case have a circular cross section, a diameter of which is from 70 to 95%.

12. A method for well stimulation, comprising introducing the device according to claim 1 into a well and positioned in such a way that a region of the device in which most of a gas is emitted after detonation of the charge packs is at a level of a perforation region of a well.

13. The method according to claim 12, wherein a container which contains at least one liquid that is suitable for increasing permeability of rock in the perforation region is provided in an intermediate space between the charge packs when using a device with charge packs that are spaced apart, and the container is destroyed and the liquid released after the detonation of the charge packs as a result of a pressure developing.

14. The method according to claim 12, wherein an absolute pressure of liquid in the well is increased before the detonation of the charge packs.

* * * * *